United States Patent [19]

Tanneberger

[11] 3,955,743

[45] May 11, 1976

[54] PACKAGING CONTAINER

[75] Inventor: Rolf Tanneberger, Schildgen, Germany

[73] Assignee: Bayer Aktiengesellschaft, Leverkusen, Germany

[22] Filed: Dec. 19, 1974

[21] Appl. No.: 534,408

[30] Foreign Application Priority Data

Jan. 8, 1974 Germany ..... 2400738

[52] U.S. Cl. ..... 229/14 BE; 229/14 BW; 229/51 TS

[51] Int. Cl.[2] ..... B65D 5/54; B65D 25/14; B65D 5/44

[58] Field of Search ..... 229/14 BE, 14 BW, 14 B, 229/51 TS, 23 R

[56] References Cited

UNITED STATES PATENTS

| | | | |
|---|---|---|---|
| 2,161,071 | 6/1939 | McGrath et al. | 229/14 B X |
| 2,170,378 | 8/1939 | Örström | 229/14 B |
| 2,292,653 | 8/1942 | Palmer | 229/14 BE |
| 2,335,913 | 12/1943 | Buttery | 229/14 B |
| 2,438,981 | 4/1948 | Waters | 229/14 BE X |
| 2,946,494 | 7/1960 | Kuss | 229/14 BE |
| 3,194,475 | 7/1965 | Ralstom | 229/38 |
| 3,561,669 | 2/1971 | Postweiler | 229/14 BW X |
| 3,871,568 | 3/1975 | Bahler | 229/14 BE X |

*Primary Examiner*—Davis T. Moorehead
*Attorney, Agent, or Firm*—Burgess, Dinklage & Sprung

[57] ABSTRACT

A container used for packaging material ranging in consistency from liquid to lumpy consists of an outer box, an inner insert and in innermost bag for receiving the material, arranged in such a way that the container can be closed almost airtightly after it has been opened.

10 Claims, 4 Drawing Figures

PACKAGING CONTAINER

Figure 1:
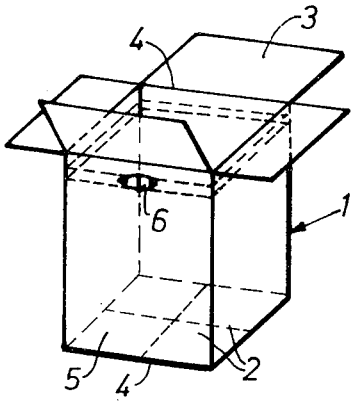

This invention relates to an inexpensive but stable packaging container for liquid and more particularly viscous or spreadable, solid and pulverulent to lumpy material which is expected to be removed in portions from the container from time to time so that the container serves not only for transport but also for storage.

Known containers of this kind have the disadvantage that they are either insufficiently stable for transport or very difficult to close sufficiently tightly once they have been opened as well as being difficult to reopen. Thus, for example, a side gusseted box with an inner bag is known in which the bag is sealed by a welding seam after it has been filled. This box has a lid extending over the entire opening of the box. Only two trapezoidal side flaps are provided. A box of this kind may be adequate for domestic packages provided it is packed in larger cartons or the like for transport. The problem of reopening and reclosing is not adequately solved in such a box.

Another packaging container is known which consists of an outer box in which two strips of cardboard are inserted crosswise and folded to form side walls and a bottom. Inside this arrangement is a bag which extends above the outer box and is sealed when filled. The outer box is then closed with a separate lid. The separation of lid and container is a disadvantage for transport.

It is an object of this invention to provide a packaging container which is satisfactory both for transport and for use as storage container which can be reopened and closed again.

According to the invention, there is provided a packaging container, comprising an outer box comprising lid flaps and side walls separated by folds; an insert arranged inside the outer box and having lid flaps and side walls separated by folds, which folds are situated at the height of the folds of the lid flaps of the outer box, one lid flap conforming to the cross-section of the insert and having a transversely extending fold whilst the three remaining flaps are shorter, all the flaps being joined to each other by folds and those flaps which are adjacent to the large flap have folds extending from the bottom edges of each of the flaps to the middle of the top edge of each flap; and a bag which is arranged inside the insert and which extends above the three shorter flaps of the insert and above the transverse fold of the large flap and is bonded to one or more of the flaps of the insert.

In another, equivalent embodiment of the packaging container according to the invention, a large flap is arranged in the outer box which then need not have any other lid flaps or only one flap on each side of the large flap. The large flap is in that case bonded to the corresponding flap of the insert, e.g. it may be glued to it, in order to obtain the desired opening and closing effect.

This arrangement ensures that the packaging container will withstand the stresses of transport and can very easily be closed and opened again after it has first been opened. To reclose it, the edge of the bag is simply placed over the short flap which is opposite the large flap and the large flap is closed. If in addition the edges of the bag are folded over each other before the large flap is closed, the package will be virtually airtight. On reopening the package, the insert is automatically opened almost completely by raising the large flap so that the contents of the container are immediately available. In another particularly advantageous feature of the package, the lid of the insert is secured by the lid flaps of the outer box during transport, the outer flaps being secured in the usual manner with an adhesive tape or the like. The fold extending transversely across the large flap of the insert has the advantage that the edges of the bag inside the insert can be sealed after filling since the part of the large flap extending above the transverse fold can be folded back.

The large flap of the insert preferably has an inserting tongue which is designed to be inserted between the outer box and the wall of the insert to close the insert more firmly.

According to another embodiment of the invention, the large flap of the insert has recesses cut out for easier handling of the lid flap.

The insert preferably has no bottom wall. This construction is quite sufficient if the bottom of the outer box is strong enough. Otherwise, the insert may according to another embodiment be constructed as a box having a bottom wall. The outer box and insert may, for example, be made of corrugated paper or cardboard. The bag may be made of paper, parchment, plastics sheet, metal foil, etc., depending on the requirements for airtightness and watertightness, greaseproofness, etc. The bag itself may, for example, be a gusset bag or a block bottom bag.

The packaging container according to the invention is illustrated in the drawing and described below.

Figure 2:
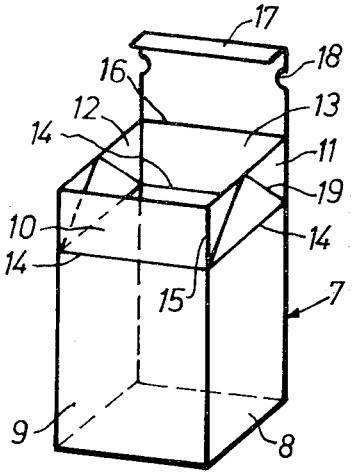
Figure 3:
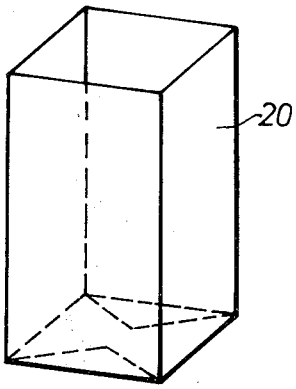
Figure 4:
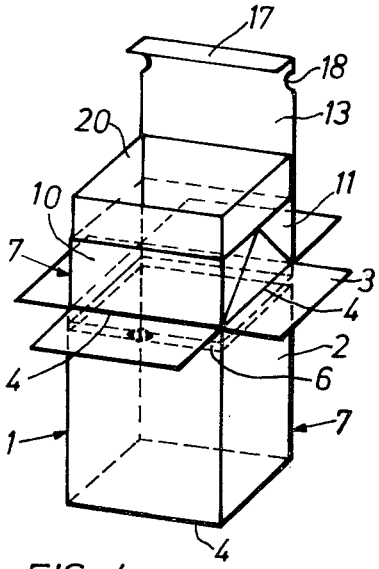

FIG. 1 shows an outer box,

FIG. 2 an insert,

FIG. 3 a bag,

FIG. 4 shows the three separate parts of the packaging container shown in FIGS. 1 to 3 essembled.

As shown in FIGS. 1 and 4, an outer box 1 comprises four side walls 2 and lid flaps 3 with folds 4 between them. The bottom flaps 5 are, like the lid flaps 3, separated from the side walls 2 by folds 4. A ripping thread for tearing the container open is indicated at 6.

An insert 7 shown in FIGS. 2 and 4 comprises a ring 8 composed of side walls 9 and lid flaps 10, 11, 12 and 13. The side walls 9 are separated from the lid flaps 10, 11, 12 and 13 and the lid flaps are separated from each other only by folds 14 and 15. The large lid flap 13 has a transverse fold 16 as well as an insertion tongue 17 and gripping cutouts 18. The lid flaps 11 and 12 have folds 19 extending from their bottom edges to the middle of their top edges.

FIGS. 3 and 4 show a bag 20 made of a composite foil of plastics and aluminum. As shown in FIG. 4, the bag 20 is bonded to the lid flaps of the insert.

I claim:

1. A packaging container, comprising an outer box comprising lid flaps and side walls separated by folds; an insert arranged inside the outer box and having lid flaps and side walls separated by folds, which folds are situated at the height of the folds of the lid flaps of the outer box, one lid flap conforming to the cross-section of the insert and having a transversely extending fold while the three remaining flaps are shorter, all the flaps being joined to each other by folds and those flaps which are adjacent to the large flap having folds extending from the bottom corner of each of the flaps to the middle of the top edge of each flap; and a bag which is arranged inside the insert and which extends above the three shorter flaps of the insert and above the transverse fold of the large flap and is bonded to one or more of the flaps of the insert.

2. A container as claimed in claim 1, wherein the large flap of the insert has an inserting tongue for inserting between the insert and the outer box.

3. A container as claimed in claim 1, wherein the large flap of the insert has handling cut-outs.

4. A container as claimed in claim 1, wherein the insert has no bottom wall.

5. A container according to claim 1, wherein the insert is in the form of a box having a bottom wall.

6. A container as claimed in claim 1, said transverse fold being disposed at the level of the upper edges of the adjacent insert lid flaps.

7. A container as claimed in claim 2, said transverse fold being disposed at the level of the upper edges of the adjacent insert lid flaps.

8. A container as claimed in claim 1, the outer box and insert, when closed, being rectangular.

9. A container as claimed in claim 2, the outer box and insert, when closed, being rectangular.

10. A container as claimed in claim 6, the outer box and insert, when closed, being rectangular.

* * * * *